US006631561B1

(12) United States Patent
Anding et al.

(10) Patent No.: US 6,631,561 B1
(45) Date of Patent: Oct. 14, 2003

(54) TURBINE BLADE AND METHOD FOR PRODUCING A TURBINE BLADE

(75) Inventors: Dirk Anding, Karlsfeld (DE); Michael Scheurlen, Ruhr (DE); Peter Tiemann, Witten (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/129,850

(22) PCT Filed: Oct. 30, 2000

(86) PCT No.: PCT/EP00/10678

§ 371 (c)(1),
(2), (4) Date: Aug. 12, 2002

(87) PCT Pub. No.: WO01/36790

PCT Pub. Date: May 25, 2001

(30) Foreign Application Priority Data

Nov. 12, 1999 (EP) ..... 99122577

(51) Int. Cl.[7] ..... B23P 15/00
(52) U.S. Cl. ..... 29/889.721; 29/889.72
(58) Field of Search ..... 29/889.7, 889.72, 29/889.721; 416/97 R, 96 R; 415/115, 116; 164/47, 131

(56) References Cited

U.S. PATENT DOCUMENTS 2,906,494 A * 9/1959 McCarty ..... 416/96 R
3,807,892 A * 4/1974 Frei et al. ..... 415/116
3,885,609 A * 5/1975 Frei et al. ..... 416/97 R
4,384,607 A * 5/1983 Wood et al. ..... 164/132
4,456,428 A * 6/1984 Cuvillier ..... 416/97 R
4,883,404 A * 11/1989 Sherman ..... 415/115
5,243,759 A * 9/1993 Brown et al. ..... 29/889.721
5,820,774 A * 10/1998 Dietrich ..... 249/61
6,039,537 A * 3/2000 Scheurlen ..... 416/97 R
6,231,303 B1 * 5/2001 Tiemann et al. ..... 415/115
6,454,533 B2 * 9/2002 Beyer ..... 416/90 R
6,493,936 B2 * 12/2002 Doi et al. ..... 29/889.7
6,530,416 B1 * 3/2003 Tiemann ..... 164/137
6,533,544 B1 * 3/2003 Tiemann et al. ..... 415/191
6,533,547 B2 * 3/2003 Anding et al. ..... 416/97 R

* cited by examiner

*Primary Examiner*—I Cuda Rosenbaum
(74) *Attorney, Agent, or Firm*—Harness, Dickey & Pierce, P.L.C.

(57) ABSTRACT

A method is for producing a turbine blade, in particular, a gas turbine blade, comprising a head, a foot, and a blade section, in addition to an internal canalization system, including individual channels through which coolant gas can pass along a flow path within the turbine blade. The turbine blade also includes a throttle device which influences the passage of the coolant gas without impairing the flow of the coolant gas in the intake area. The throttle device is located in the rear section of the flow path, and is positioned upstream of the exit openings.

8 Claims, 4 Drawing Sheets

TURBINE BLADE AND METHOD FOR PRODUCING A TURBINE BLADE

This application is the national phase under 35 U.S.C. §371 of PCT International Application No. PCT/EP00/10678 which has an International filing date of Oct. 30, 2000, which designated the United States of America, the entire contents of which are hereby incorporated by reference.

FIELD OF THE INVENTION

The invention generally relates to a turbine blade, in particular a gas turbine blade. More preferably, it relates to one having a tip region, a root region and a blade-body region. It may have an inner passage system of individual passages, through which cooling gas can be directed on a flow path inside the turbine blade, and a throttle device influencing the throughflow of the cooling gas. Cooling gas may be directed in the passages from the root region through the blade-body region to the tip region and can be diverted in the opposite direction. Also, it may have outlet openings for discharging the cooling gas from the turbine blade, with these outlet openings being arranged on the outflow side of the turbine blade. The invention may generally relate to a method of producing a turbine blade. In order to achieve a high efficiency during the operation of a turbine with an action fluid, in particular of a gas turbine operated with a gas, the action fluid is heated to a high temperature. In a gas turbine with a combustion chamber for producing the hot gas, the guide and moving blades nearest to the combustion chamber are subjected to a throughflow of cooling gas so that they withstand the high temperatures prevailing there, which are partly above the critical values of the material used for producing the turbine blade. The temperature on and inside the turbine blade is reduced by the cooling gas, so that the mechanical stability and thus the operability of the turbine blade under these conditions are ensured.

BACKGROUND OF THE INVENTION

In this type of cooling, an outer wall of the turbine blade around which an action fluid flows encloses a meander-shaped passage system which repeatedly directs the cooling gas from a root region up to a tip region of the turbine blade and back again to the root region. The region in which the cooling gas is introduced is designated as leading edge region, and the region in which cooling gas is discharged is designated as trailing edge region. A plurality of outlet openings are provided in the trailing edge region, these outlet openings connecting the passage system of the turbine blade to an exterior space through which the action fluid flows. During operation of the turbine, cooling gas from the passage system of the turbine blade discharges from the openings right onto the surface of the outer wall.

In order to save cooling gas and thereby increase the output of the gas turbine, only as much cooling gas as is absolutely necessary in order to avoid overheating is to be used for the blades. Since many assumptions with regard to various heat transfers are made when designing a blade, these assumptions being construed on the conservative side in order to avoid damage to the blades, and since the actual geometrical configuration of the turbine blades also cannot be established until after the casting is complete, the flow of the cooling gas through the blades is set subsequently, after the casting.

This is normally done by providing leading edge holes or aperture plates in the region of the leading edge for the cooling air entering the turbine blade, these leading edge holes or aperture plates throttling the entry of the cooling gas into the blade. A disadvantage in this case, however, is that these throttling devices have a considerable loss factor and may in addition lead to flow separation in the region of the entry of the cooling gas, so that adequate cooling in this region of the turbine blade cannot be ensured. In addition, this configuration also impairs the leading edge region, in which the pressure difference between first cooling chamber and external hot gas decreases.

SUMMARY OF THE INVENTION

An object of an embodiment of the present invention is therefore to design a turbine blade which has a throttle device for setting the throughflow of the cooling gas without influencing the flow of the cooling gas at the leading edge. Another alternative object of an embodiment of the invention is to specify a method of producing such a turbine blade. This method may be simple in terms of design and also being individually adaptable.

An object may also be achieved by the throttle device being arranged upstream of the outlet openings in the rear region of the flow path. By such an arrangement of the throttle device, the throughflow of the cooling gas can be throttled without adverse effects on the flow of the cooling gas. The flow at the leading edge is effected largely undisturbed. The throttling only begins in a rear region of the flow path. The cooling-gas flow has left most of its path behind it and has already fulfilled the tasks of heat dissipation, which are linked with sufficient flow velocity.

The pressure difference between the first cooling chamber and the surrounding hot action fluid is retained, so that no hot gas can enter the blade, a factor which would lead to considerable damage. Reliable cooling of the turbine blade is therefore ensured. At the same time, the consumption of cooling gas is minimized. Only as much cooling gas as is absolutely necessary in order to prevent overheating has to be used. In this way, optimum cooling of the turbine blade and at the same time good efficiency of the turbine are obtained.

Favorable flow control of the cooling-gas flow is possible if the throttle device is attached at a reversing point of a passage. Here, the cross section of the passage and thus the throughflow of the cooling gas can be set to a predetermined degree in a simple manner. Possible dimensional differences which result from the production of the gas turbine can be rendered harmless by the throttle device. Thus the same type of throttle device may also be used on different models of turbine blade. This reduces the number of different components of the turbine blade which are required.

It is especially advantageous if the throttle device is attached at the last reversing point arranged upstream of the outlet openings. At this point, the flow path opens out, so that after that sufficient throttling with high efficiency is no longer possible. At the same time, the cooling gas has a maximum flow path and thus maximum contact with the inner surface of the passage system, a factor which optimizes the cooling effect.

It is especially advantageous if the throttle device is attached in a lead-through opening brought about by the casting process. Lead-through openings, which are produced, for example, by core mounts of the casting core during the casting, can be appropriately utilized in this way. They are normally closed merely by means of plates. The throttle device performs the same closing function and at the same time throttles the cooling-gas flow. By means of this throttle device, it is possible to set the throughflow subsequently and compensate for any possible dimensional inaccuracies after the casting. By utilizing the lead-through openings, production steps can thus be saved, which greatly reduces the production costs.

In order to prevent loss of the throttle device during operation or an undesirable penetration of the throttle device into the passage system, it is advantageous if the lead-through opening is permanently closed by the throttle device. If the throttle device were to be shaken loose and were to get into the passage system, for example during pronounced thermal and mechanical loading of the turbine blade, considerable damage to the turbine blade or complete failure of the cooling could be caused, which would result in breakdown of the turbine within a short time. A throttle device located outside the turbine blade inside the turbine may also cause considerable damage. In addition, the cooling effect would be reduced by the cooling gas being discharged into the environment at an unsuitable point through the lead-through opening, which has been cleared on account of the loss of the throttle device.

It is advantageous if the throttle device is arranged in the root region. As a result, the throttle device can be reached without any problems during inspections of the turbine blade and it is possible to check it for its sealing and throttling effect.

Good stability and operability are provided for if the throttle device is formed by a throttling projection of a plug. In this case, the plug is in each case designed in such a way that it is individually adapted to the outside dimensions of the opening into which it is inserted. This is especially advantageous when the opening is a lead-through opening brought about by the casting process, since its dimensions fluctuate with different models of turbine blade. The throttling is effected by the throttling projection, which fulfills its function even in a very simple construction. The throttling projection can thus be of robust design while ensuring its function, as a result of which the throttle device requires little maintenance and works reliably. The throttling is also reliably ensured at high throughflow rates of the cooling gas and at high associated pressures or greatly fluctuating loads.

Accurate matching of the cooling-gas flow is possible if the throttle device is formed by a foot of a screw calked in a plug. In this case, the screw is inserted into the plug, which is fastened in the lead-through opening. In this way, it is not necessary to make a screw thread in the cast turbine blade. The screw inserted into the plug can be set in an infinitely variable manner and permits individual adaptation of the throttling to the flow requirements of the trailing edge region. The screw is locked in the desired position by the caulking.

Fixed retention is ensured by the plug being welded in place. In this way, the plug, with simple measures, can be accurately fastened and held in the desired position in the opening of the turbine blade, in which it is inserted, without deforming surrounding material for example. The opening may be a lead-through opening brought about by the casting process, but also an opening made in the turbine blade after the casting, for example by drilling. In this case, the location of the throttle device can be better adapted to the model- or casting-dependent requirements.

An object relating to the production of a turbine blade may be achieved in that, after the casting operation, a throttle device influencing the throughflow of the cooling gas is introduced in the rear region of the flow path in such a way as to be arranged upstream of the outlet openings. While the throughflow of the cooling gas is measured, is set up in a lead-through opening brought about by the casting process in such a way that a predetermined value of a throughflow parameter of the cooling gas is achieved, and then the throttle device is fastened permanently in the throttling position.

Due to this procedure, certain cooling-gas throttling still does not have to be taken into account during the casting operation itself. This facilitates the casting operation, simplifies the casting molds and reduces the scrap. An opening brought about by the casting, for example produced by a connection between the casting core and the outer casting shell, this connection holding the core in its position, can be utilized in this way. At the same time, the throttle device closes the lead-through opening. In this way, a work step which is otherwise necessary is saved.

By the subsequent measuring of the throughflow of the cooling gas, the cooling-gas flow can be matched individually and with simple measures to the cooling-gas demand of a turbine blade. The setting is facilitated in this case, since the throttling effect can be influenced from outside in a simple manner. The subsequent fastening of the throttle device in the lead-through opening may likewise be effected from outside. In this case, the fastening, due to the measuring of the cooling-gas flow, can be directly controlled and if need be repeated without damaging the turbine blade.

The production method is very similar for different types of blade if the casting core, during the casting operation, is held in its position relative to the outer casting shell by a guide mount in the root region of the turbine blade, and in that a throttle device is inserted into the lead-through opening brought about by the mount. This facilitates the production process and reduces the conversion time and the number of parts to be used during the production of different types of turbine blade.

An especially simple and easily reproducible production method with low material costs is provided for by the cooling-gas flow being measured in each case after the insertion of plugs having different throttling projections, and by the plug which produces a predetermined throughflow of the cooling gas being welded in place. The throttling projection is also predetermined by the selection of a plug. Thus the plug, by a model measurement, can be more or less the same for turbine blades of the same series. This reduces the production costs, since work steps are simplified or dispensed with.

Individual setting of the cooling-air flow is possible by a plug having a throttle screw, which has a throttling projection projecting into the flow path, being inserted into the lead-through opening brought about by the casting process, and by the throughflow being measured while the screw is adjusted, the screw then being calked in the desired throttling position.

The screwing position can be varied in an infinite manner during the continuous measurement. This permits a very accurate setting adapted to the cooling requirements. The caulking of the screw provides for reliable fastening without damaging the material of the turbine blade. For a series of turbine blades which have approximately the same cooling requirements and the same internal construction of the cooling passages, a screw setting determined beforehand during an exemplary cooling-air measurement can be marked and set. The plug with the set screw is then inserted directly into the turbine blade and the screw is calked.

BRIEF DESCRIPTION OF THE DRAWINGS

The invention is explained in more detail with reference to the exemplary embodiments shown in the drawings, in which.

DETAILED DESCRIPTION OF THE PREFERRED EMBODIMENTS

Figure 1:
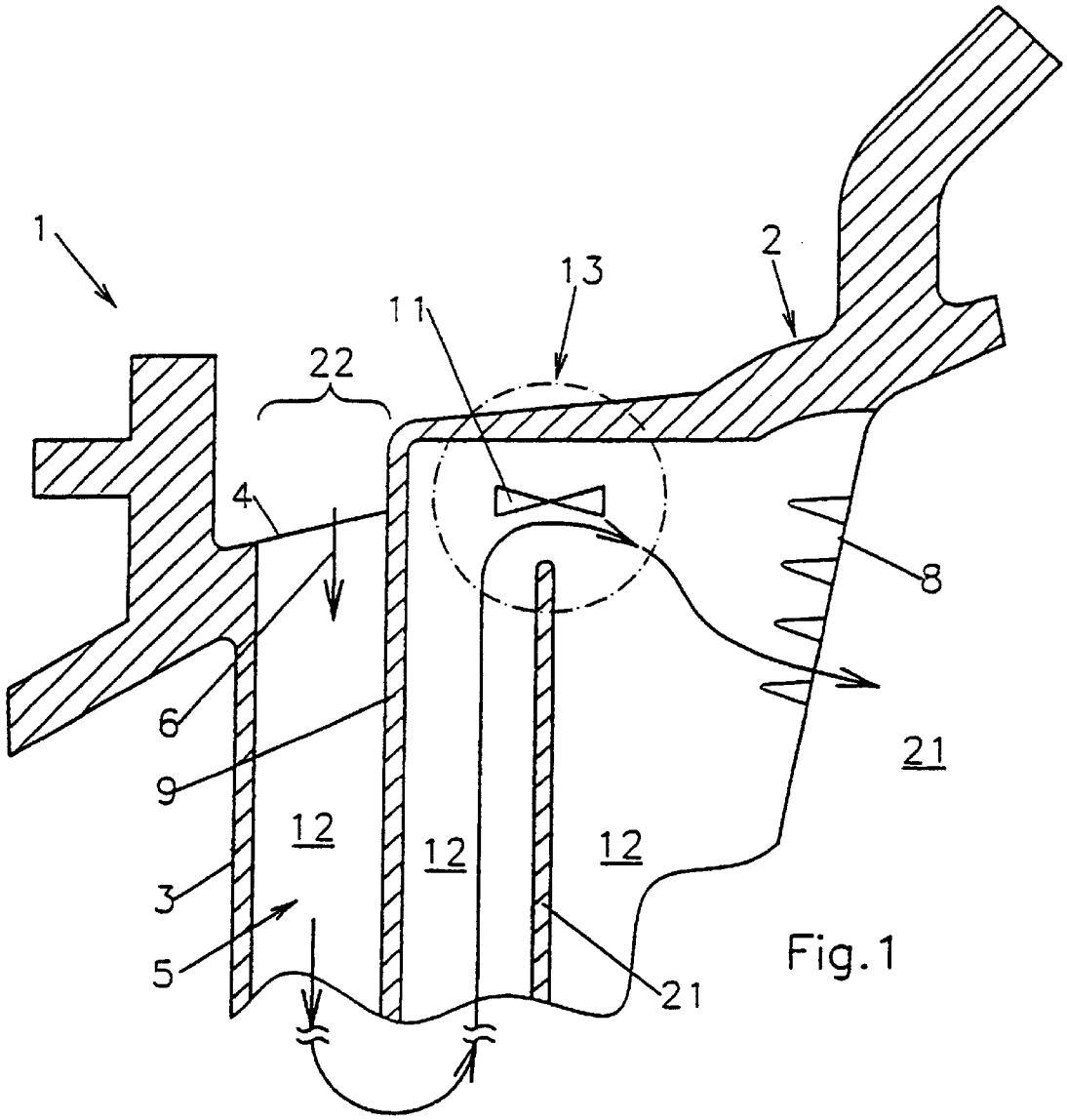
FIG. 1 shows a longitudinal section through a root region of a turbine blade with throttle device.

FIG. 1 shows a longitudinal section through a root region 2 and part of a passage systems of a gas-cooled turbine blade 1. The passage system 5 is located essentially in the blade-body region 3 of the turbine blade 1. It has an inlet opening 22 at the root region 2, at the start of the flow path 6 of the cooling gas, through which inlet opening 22 cooling gas is passed into the passage system 5, and also outlet openings 8 in the outflow region 21 of the turbine blade 1, through which outlet openings 8 the cooling gas leaves the passage system 5 at the end of the flow path 6 of the cooling gas.

On its flow path 6, the cooling gas is directed in a meander shape in the passages 12, which are separated from one another by intermediate walls 21, repeatedly from the root region 2 to the tip region (not shown) and back again to the root region 2. The passages 12 are connected to one another by reversing points 13 which adjoin the root region 2 or the tip region. A throttle device 11 influencing the throughflow of the cooling gas is located in the rear region of the flow path 6 upstream of the outlet openings 8. The flow in the region of the inlet opening 22 is therefore not disturbed and at the same time the demand for cooling gas is reduced.

Figure 2:
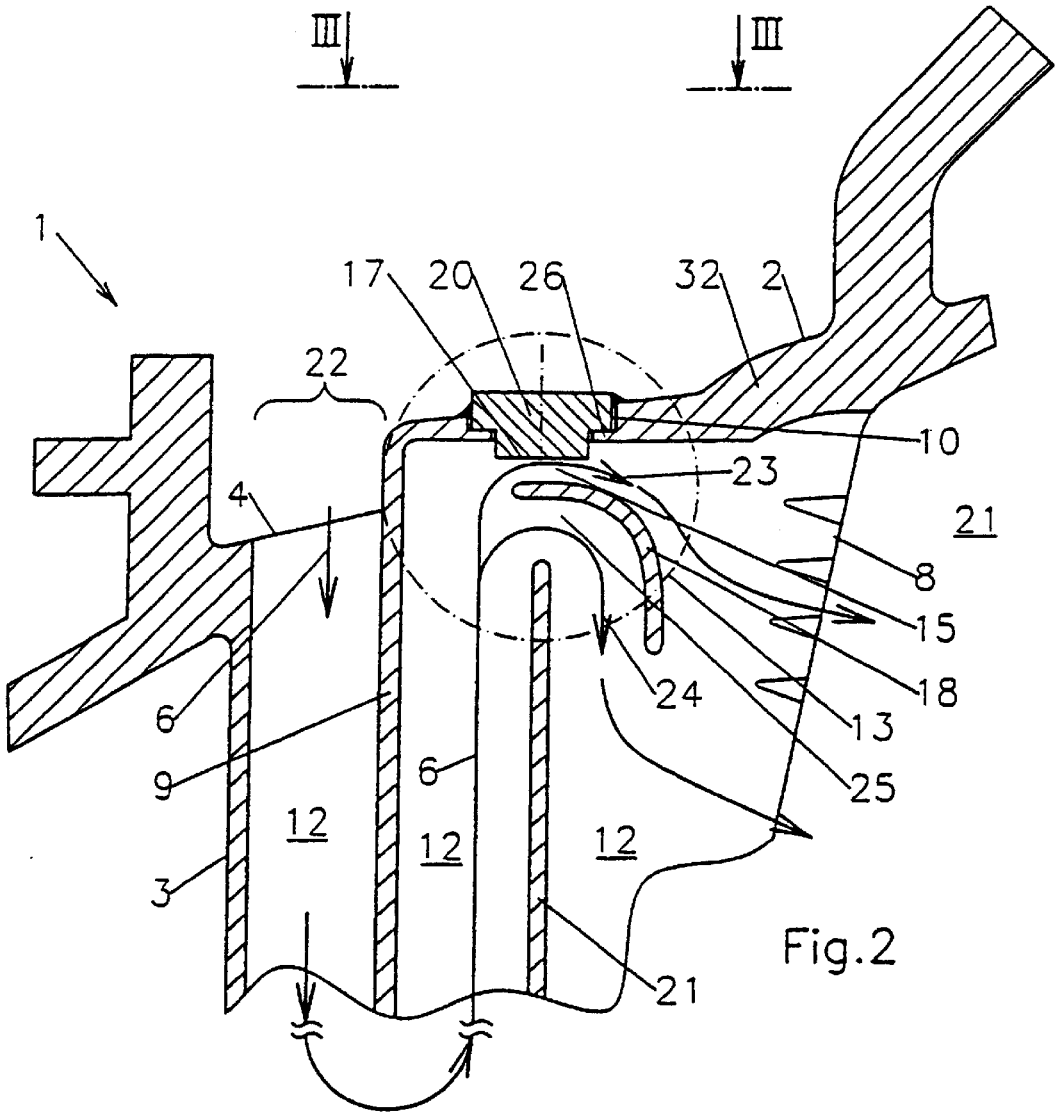
FIG. 2 shows a longitudinal section through a root region with a plug.
Figure 6:
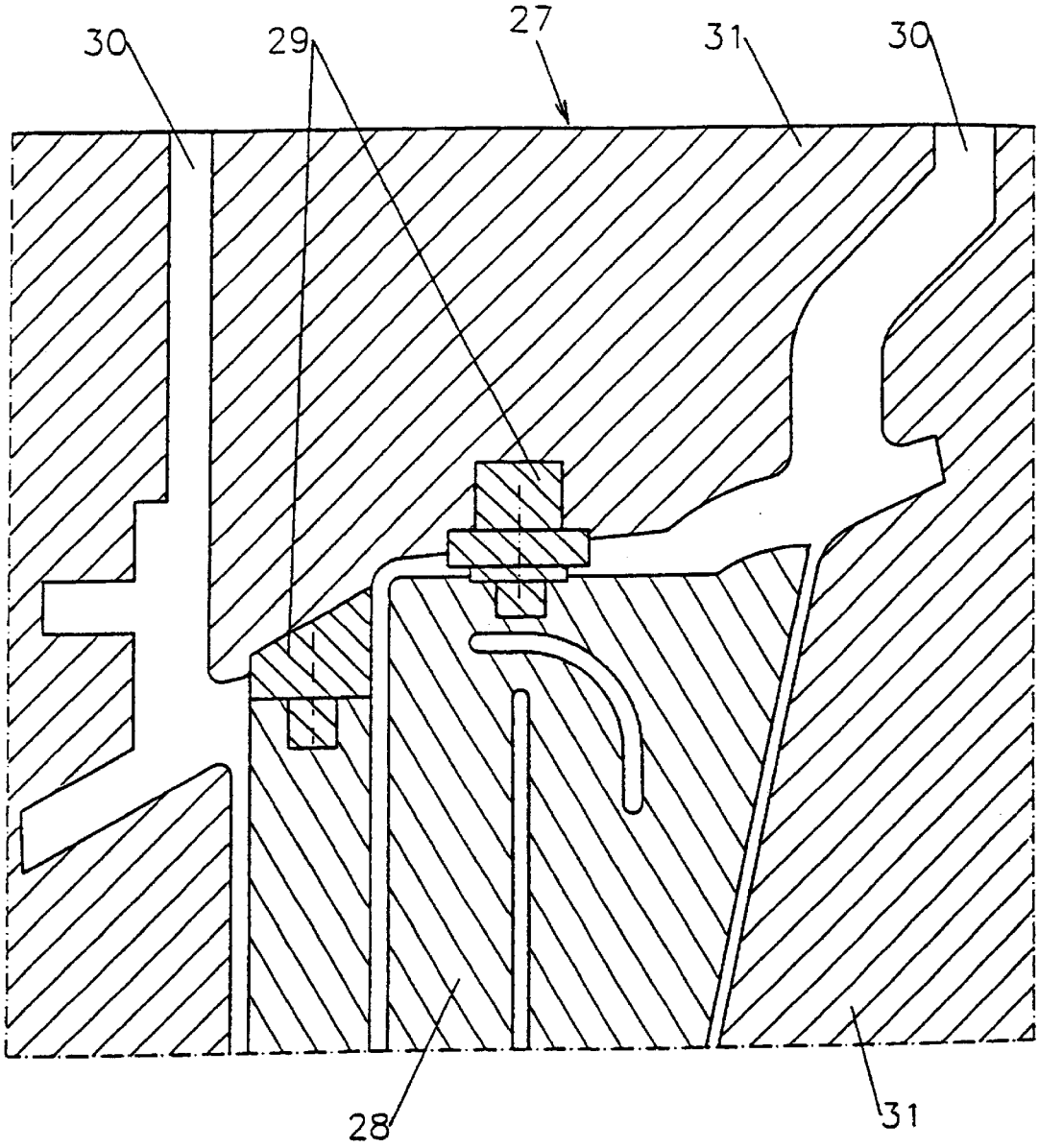
FIG. 6 shows a casting mold with a casting core.

FIG. 2 shows a longitudinal section through the root region 2 of a turbine blade with a throttling plug 20. The plug 20 is held by means of a step 26 in a lead-through opening 10. The plug 20 has a throttling projection 17, with which the cooling-gas flow can be reduced in the inserted state. The plug 20 is attached at the last reversing point 13 before discharge of the cooling gas from the passage system 5 in an opening in the wall 32 of the root region 2 of the turbine blade 1. The attachment is advantageously in an opening brought about by the casting process, since a production step of the turbine blade 1 is thereby saved and the plug 20 at the same time sits at a point favorable for the throttling, namely the reversing point 13 of a passage. Core-retaining pieces 29 are preferably located at these points during the casting, as shown in FIG. 6, these core-retaining pieces 29 fastening and securing the casting core 28 relative to the surrounding casting shell 31, so that predetermined dimensions are maintained.

By use of a curved guide rib 18, the flow path 6 is split at the reversing point 13 into two partial-flow paths: a first cooling-gas partial-flow path 23, which is directly adjacent to the root region 2, and a second cooling-gas partial-flow path 24, which is separated by the cooling rib 18. The cooling-gas partial flows directed therethrough, after passing the guide rib 18, are united again and leave the turbine blade 1 through the outlet openings 8. The throttle device 11 throttles the first cooling-gas partial flow. The second cooling-gas partial flow, irrespective of the intensity of the throttling by the plug 20, flows through a side passage 25 of constant size. A minimum cooling-gas flow is therefore always ensured.

Figure 3:
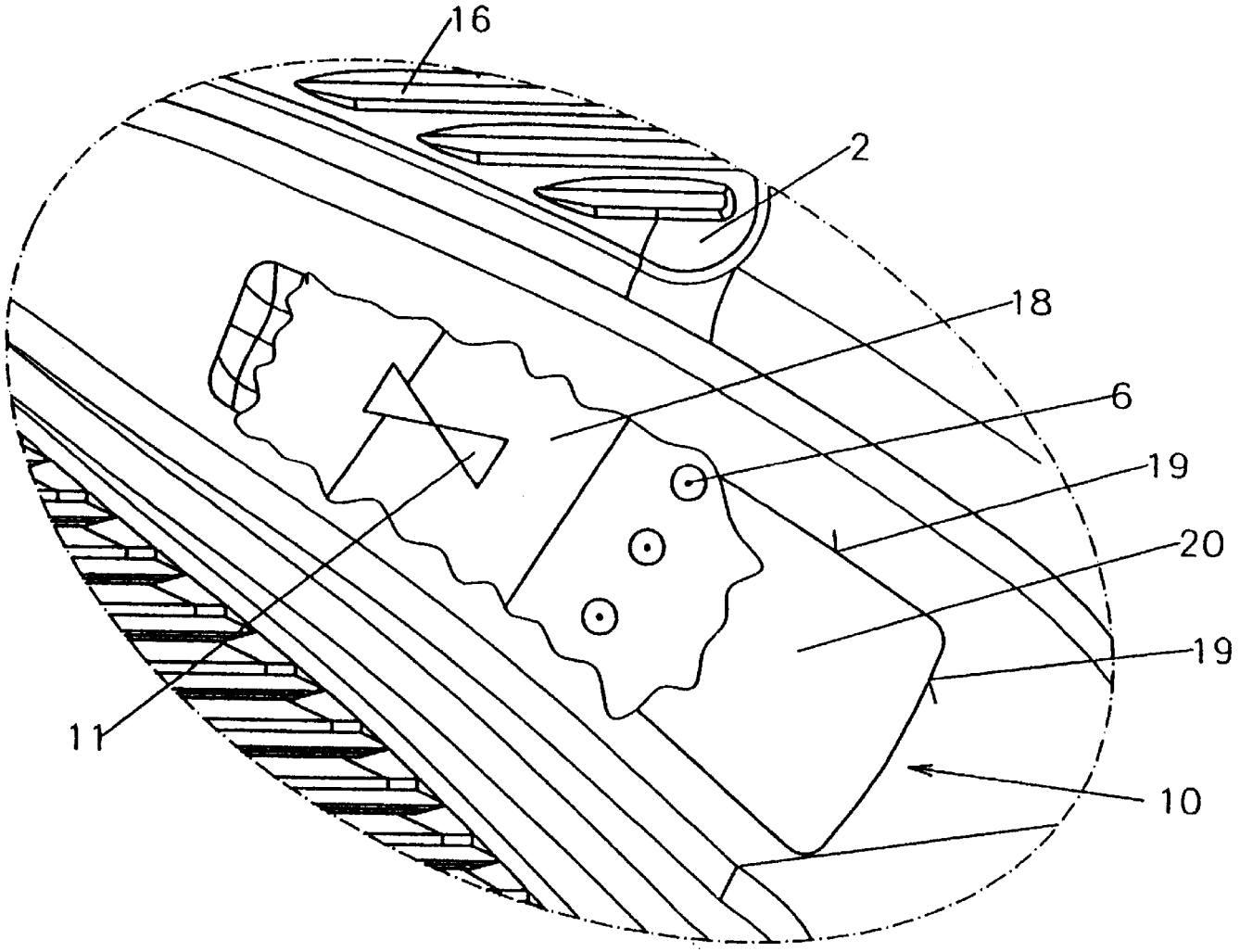
FIG. 3 shows a perspective plan view of a root region of a turbine blade with plug.

FIG. 3 shows a perspective plan view of a root region 2 of a turbine blade which has a lead-through opening 10 brought about by the casting process and a plug 20 closing the latter. As shown in FIG. 6, this lead-through opening 10 is produced during the casting of the turbine blade 1. It has the negative shape of a guide mount 29, by which the casting core 28, which forms the passage system 5, is connected to the outer casting shell 31, so that the casting core 28 maintains the desired position during the casting and the subsequent cooling of the casting material. In this case, the lead-through opening 10 is designed to be longitudinally elongated with four side walls 19.

Figure 4:
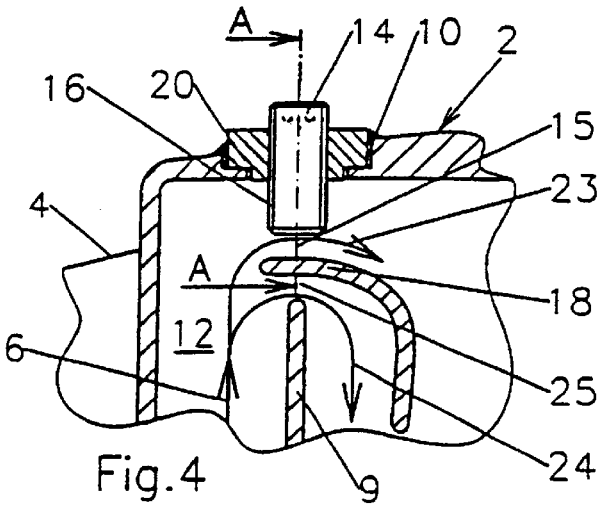
FIG. 4 shows a longitudinal section through a root region with a plug and a throttle screw.

FIG. 4 shows a detail view of a reversing point 13 with a throttle device which is composed of a plug 20 and a throttle screw 14. The plug 20 is fastened, preferably welded, in the lead-through opening 10. The throttle screw 14 is screwed into the plug 20. With its foot 16, which serves as throttling projection, it projects from the plug 20 into the throttle region 15 and thus into the first cooling-gas partial flow 23. The position of the throttle screw 14 or of its foot 16 is continuously variable. In a throughflow measuring state (not shown), the throughflow of the cooling gas is measured and the position of the throttle screw 14 varied until a desired throughflow is reached. The throttle screw 14 is then fastened in the plug 20. To this end, the screw is calked, brazed-on or welded.

Figure 5:
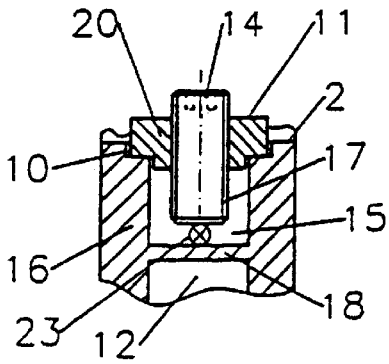
FIG. 5 shows a longitudinal section through a root region of a turbine blade.

FIG. 5 shows a longitudinal section through the root region 2 at a 90° angle to the longitudinal section from FIG. 4. The throttle screw 14 is in the throttling position, screwed into the plug 20, which is fastened in the lead-through opening 10. The throttling projection 17 closes the throttle region 15, through which the first cooling-gas partial flow flows. Depending on the size of the foot 16 of the screw, only part of the flow path is closed, as shown in FIG. 5. However, accurate adaptation of the foot to the throttle region is also possible, as a result of which the entire flow path in the region can be blocked.

FIG. 6 shows a casting mold 27 with casting core 28 and outer casting shell 31. The casting core 28 is connected to the outer casting shell 31 via guide mounts 29, called core marks. The casting material is directed via casting passages 30 into the interior of the casting mold 27 and solidified. The guide mount 29 ensures that the casting core 28 maintains the correct position during the casting operation and during the cooling of the casting material and that the dimensioning requirements are fulfilled. After the casting operation, the guide mount 29 is removed and a lead-through opening 10 brought about by the casting process is thus produced in its place in the root region 2 of the turbine blade 1.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A method of producing a turbine blade, including a tip region, a root region, a blade-body region, and an inner passage system of individual passages, through which cooling gas can be directed on a flow path inside the turbine blade, and including a throttle device influencing the throughflow of the cooling gas, wherein cooling gas can be directed in the passages from the root region through the blade-body region to the tip region and can be diverted in the opposite direction, and also including outlet openings for discharging the cooling gas from the turbine blade, wherein the outlet openings are arranged on the outflow side of the turbine blade, the method comprising:

performing a casting operation with a casting mold, including a casting core and an outer casting shell;

introducing, after the casting operation, a throttle device influencing the throughflow of the cooling gas, wherein the device is introduced in the rear region of the flow path in such a way as to be arranged upstream of the outlet openings and, while the throughflow of the cooling gas is measured, is set up in a lead-through opening brought about by the casting process in such a way that a predetermined value of a throughflow parameter of the cooling gas is achieved; and fastening the throttle device permanently in the throttling position.

2. The method as claimed in claim 1, wherein the casting core, during the casting operation, is held in its position relative to the outer casting shell via a guide mount in the root region of the turbine blade, and wherein a throttle device is inserted into the lead-through opening brought about by the mount.

3. The method as claimed in claim 1, wherein the cooling-gas flow is measured after the insertion of plugs including different throttling projections, and wherein the plug which produces a predetermined throughflow of the cooling gas is welded in place.

4. The method as claimed in claim 1, wherein a plug, including a throttle screw which has a throttling projection projecting into the flow path, is inserted into the lead-through opening brought about by the casting process, and wherein the throughflow is measured while the screw is adjusted, the screw then being caulked in the desired throttling position.

5. The method as claimed in claim 2, wherein the cooling-gas flow is measured after the insertion of plugs including different throttling projections, and wherein the plug which produces a predetermined throughflow of the cooling gas is welded in place.

6. The method as claimed in claim 2, wherein a plug, including a throttle screw which has a throttling projection projecting into the flow path, is inserted into the lead-through opening brought about by the casting process, and wherein the throughflow is measured while the screw is adjusted, the screw then being caulked in the desired throttling position.

7. The method as claimed in claim 3, wherein a plug, including a throttle screw which has a throttling projection projecting into the flow path, is inserted into the lead-through opening brought about by the casting process, and wherein the throughflow is measured while the screw is adjusted, the screw then being caulked in the desired throttling position.

8. The method of claim 1, wherein the method is for producing a gas turbine blade.

* * * * *